US006367944B1

(12) United States Patent
Wang

(10) Patent No.: US 6,367,944 B1
(45) Date of Patent: Apr. 9, 2002

(54) SOCKET WRENCH AND LIGHT SOURCE ARRANGEMENT

(76) Inventor: Lai-Fu Wang, No. 425, Hsihu Rd., Tali (TW)

( * ) Notice: Subject to any disclaimer, the term of this patent is extended or adjusted under 35 U.S.C. 154(b) by 0 days.

(21) Appl. No.: 09/756,725

(22) Filed: Jan. 10, 2001

(51) Int. Cl.[7] ..... B25B 23/18
(52) U.S. Cl. ..... 362/119; 362/109; 362/253
(58) Field of Search ..... 362/119, 120, 362/253, 109

(56) References Cited

U.S. PATENT DOCUMENTS 4,253,134 A * 2/1981 Barnaby ..... 362/119
5,477,434 A * 12/1995 Reed ..... 362/119
5,826,968 A * 10/1998 Brantley et al. ..... 362/119
5,882,103 A * 3/1999 Brantley et al. ..... 362/119
6,033,081 A * 3/2000 Huang ..... 362/119
6,092,907 A * 7/2000 Brantley et al. ..... 362/119
6,183,103 B1 * 2/2001 Hillinger ..... 362/119

* cited by examiner

*Primary Examiner*—Thomas M Sember
(74) *Attorney, Agent, or Firm*—Rosenberg, Klein & Lee

(57) ABSTRACT

A socket wrench and light source arrangement includes a wrench, and a socket coupled to the wrench which is alternatively set between a front working position and a rear working position. A battery is installed in the wrench. A lamp holder assembly is installed in the socket and adapted to emit light through the front open side of the socket. The lamp holder assembly is electrically connected to the battery to emit light when the socket is set in the rear working position, or electrically disconnected from the battery to turn off light when the socket is set in the front working position or separated from the wrench.

1 Claim, 3 Drawing Sheets

SOCKET WRENCH AND LIGHT SOURCE ARRANGEMENT

BACKGROUND OF THE INVENTION

The present invention relates to a socket wrench and, more specifically, to a socket wrench and light source arrangement, which is inexpensive to manufacture and easy to operate.

Various screwdrivers with light source means have been disclosed, and have appeared on the market. A screwdriver with light source means is practical for use in a dark place. Further, different wrenches may be used when repairing the tires or parts of a motor vehicle. However, regular commercially available wrenches for motor vehicle repair works are not equipped with light source means. When using a wrench to repair a motor vehicle in the dark, an external light source must be provided.

SUMMARY OF THE INVENTION

It is one object of the present invention to provide a socket wrench, which has a light source installed therein. It is another object of the present invention to provide a socket wrench, which can be set between a first working position to turn on the light source installed therein, and a second working position to turn off the light source. It is another object of the present invention to provide a socket wrench and light source arrangement, which enables the user to remove the light source unit from the socket wrench easily without affecting the function of the socket wrench. According to the present invention, the socket wrench and light source arrangement comprises a wrench, the wrench comprising a polygonal socket hole, a battery chamber axially disposed inside the socket hole, and two locating grooves spaced around the periphery of the socket hole at different elevations, a socket coupled to the wrench and alternatively secured to the locating grooves between a first working position and a second working position, and a light source unit, the light source unit comprising a battery installed in the battery chamber of the wrench, an electrically insulative holder plate mounted in the socket and holding a metal contact plate, a metal spring, and a lamp, for example, a LED. The LED is electrically connected to the battery to emit light when the socket is set in the first position, or electrically disconnected from the battery to turn off light when the socket is set in the second position.

BRIEF DESCRIPTION OF THE DRAWINGS

FIG. 3A is another sectional view of the present invention, showing the socket fastened to the wrench, the steel balls engaged into the rear locating groove of the wrench, the metal spring pressed on one terminal of the battery, the LED turned on.

DETAILED DESCRIPTION OF THE PREFERRED EMBODIMENT

Figure 1:
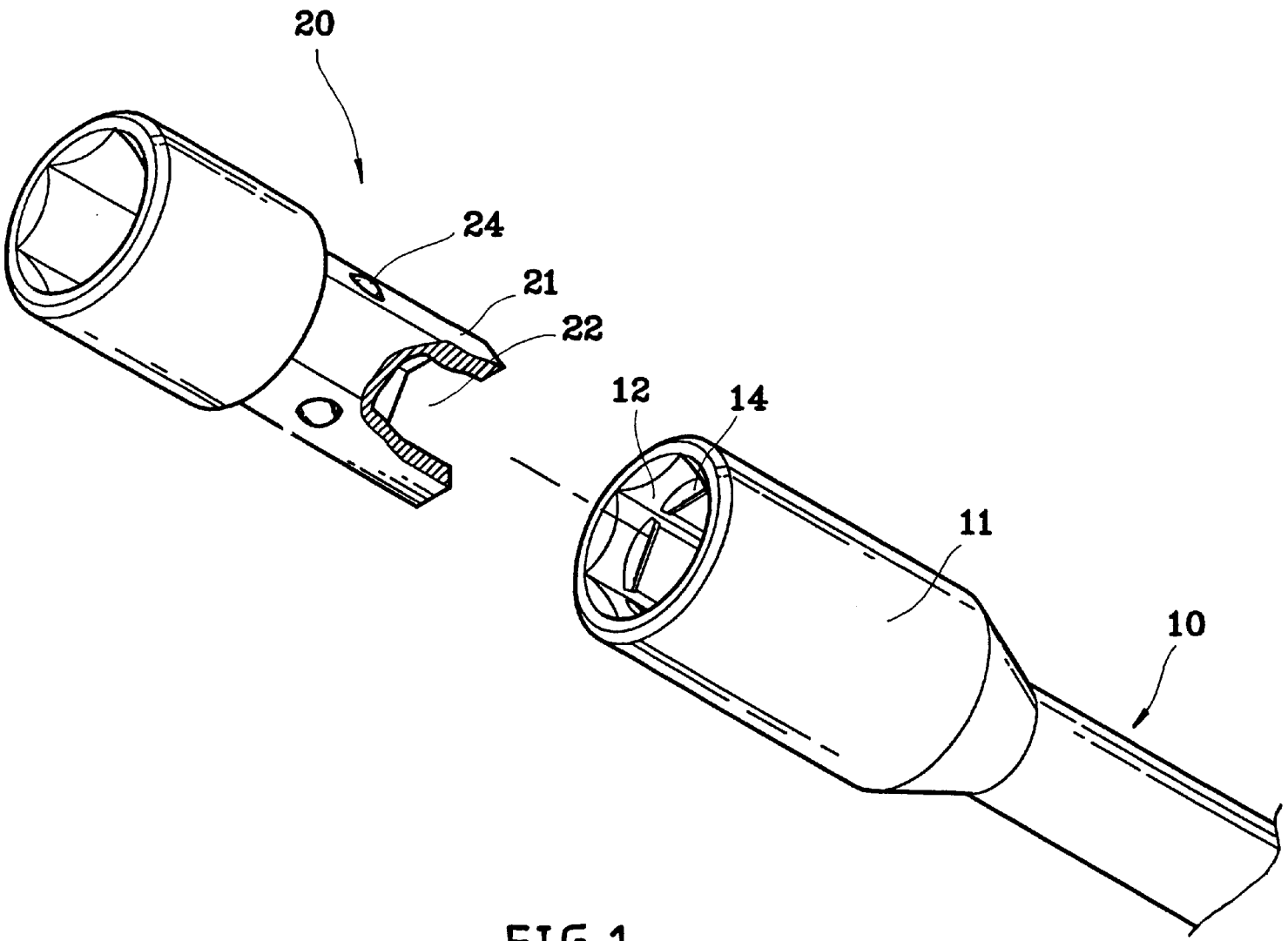
FIG. 1 is an exploded, partially cutaway of the present invention.
Figure 2:
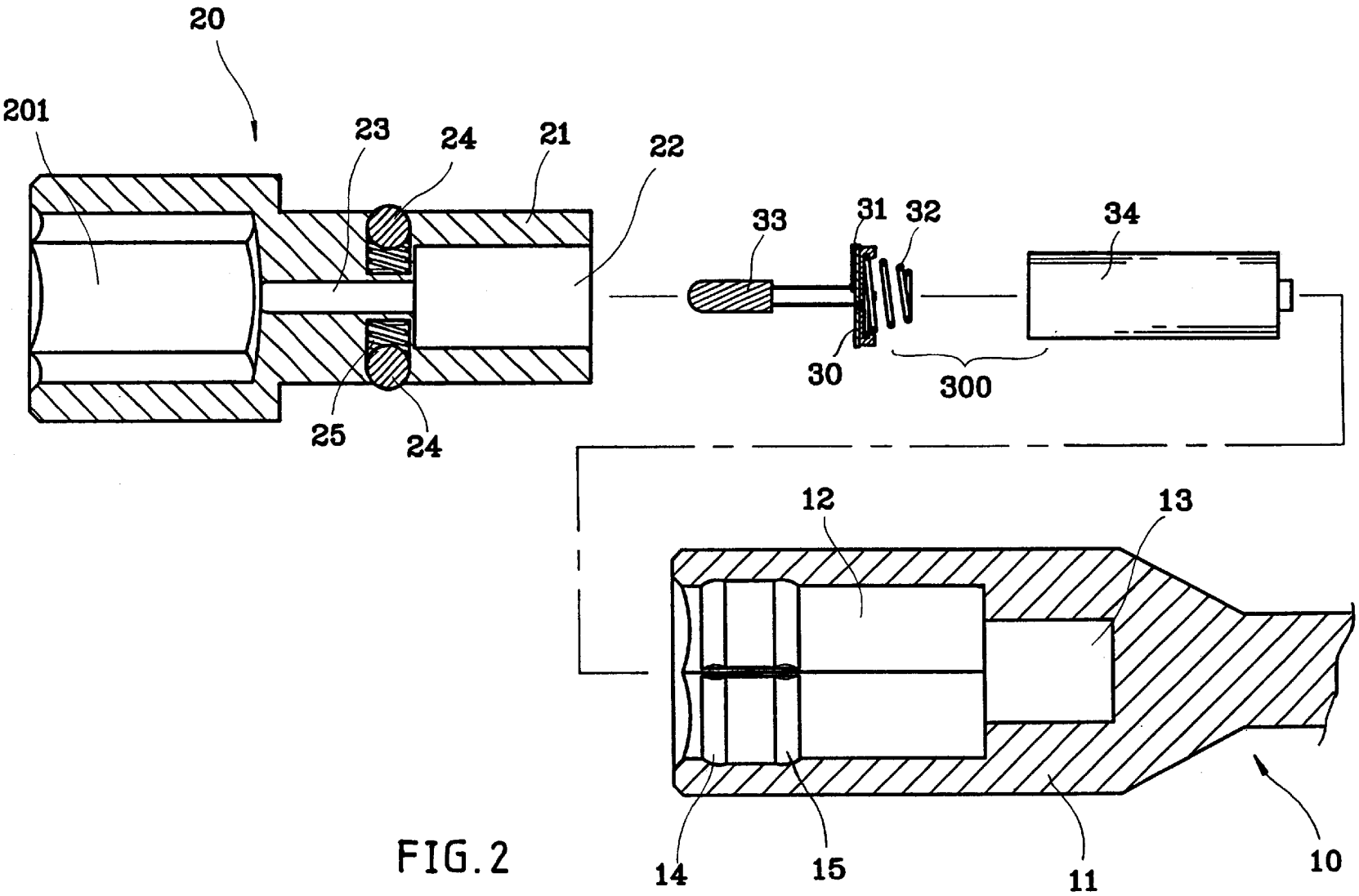
FIG. 2 is an exploded view in section of the present invention.

Referring to FIGS. from 1 through 3, the present invention comprises a metal wrench 10 having a coupling head 11 and a polygonal socket hole 12 in the coupling head 11, a metal socket 20 having a polygonal coupling hole 201 and a polygonal coupling head 21, and a light source 300. The polygonal coupling head 21 of the socket 20 comprises a plurality of compression springs 25 mounted in respective radial holes around the periphery thereof, and a plurality of steel balls 24 respectively supported on the compression springs 25. After insertion of the polygonal coupling head 21 of the socket 20 into the polygonal socket hole 12 of the wrench 10, the steel balls 24 are forced by the respective compression springs 25 against the inside wall of the wrench 10, and therefore the socket 20 is positively secured to the wrench 10.

The coupling head 11 of the wrench 10 comprises a front locating groove 14 and a rear locating groove 15 spaced around the periphery of the polygonal socket hole 12 near the front open side thereof, and a battery chamber 13 axially backwardly extended from the polygonal socket hole 12. The polygonal coupling head 21 of the socket 20 comprises an axially extended receiving open chamber 22, and an axial through hole 23 connected between the receiving open chamber 22 and the polygonal coupling hole 201. The light source unit 300 is comprised of a battery 34 mounted in the battery chamber 13 of the wrench 10, an electrically insulative holder plate 30 press-fitted into the receiving open chamber 22 of the socket 20, a lamp, for example, a LED (light emitting diode) 33 mounted on the holder plate 30 and inserted into the axial through hole 23 of the socket 20, a metal contact spring 32 mounted in the bottom side of the holder plate 30 and connected to one terminal of the LED 33, and a metal contact plate 31 fixedly fastened to the front side of the holder plate 30 and connected to the other terminal of the LED 33 and maintained in contact with the inside wall of the socket 20.

Figure 3A:
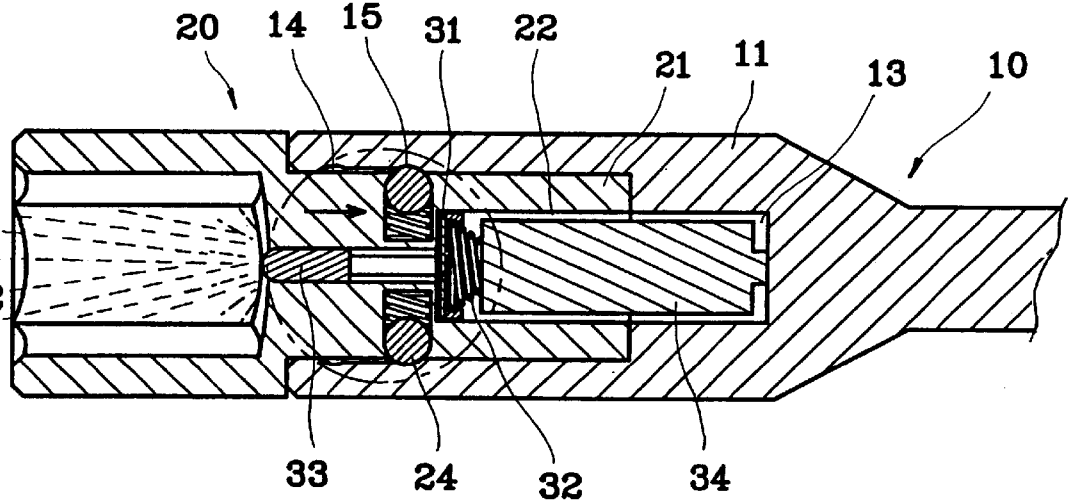
Figure 3:
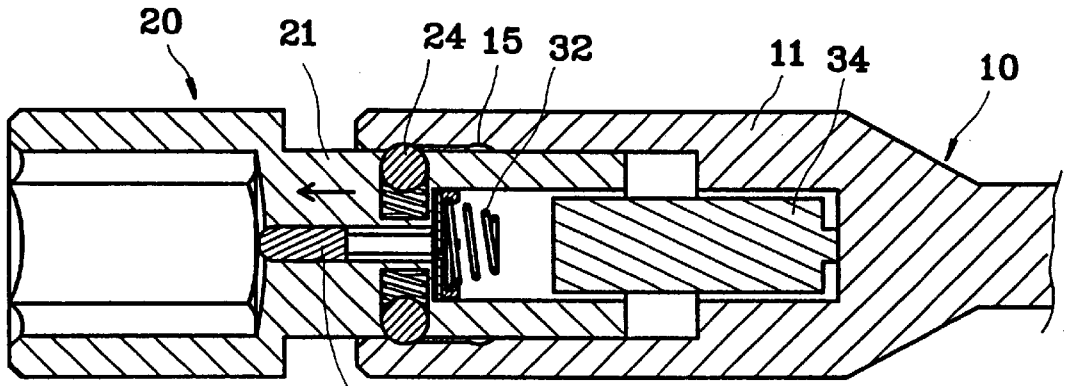
FIG. 3 is a sectional view of the present invention, showing the socket fastened to the wrench, the steel balls engaged into the front locating groove of the wrench, the metal spring spaced from the battery, the LED turned off.
Figure 3B:
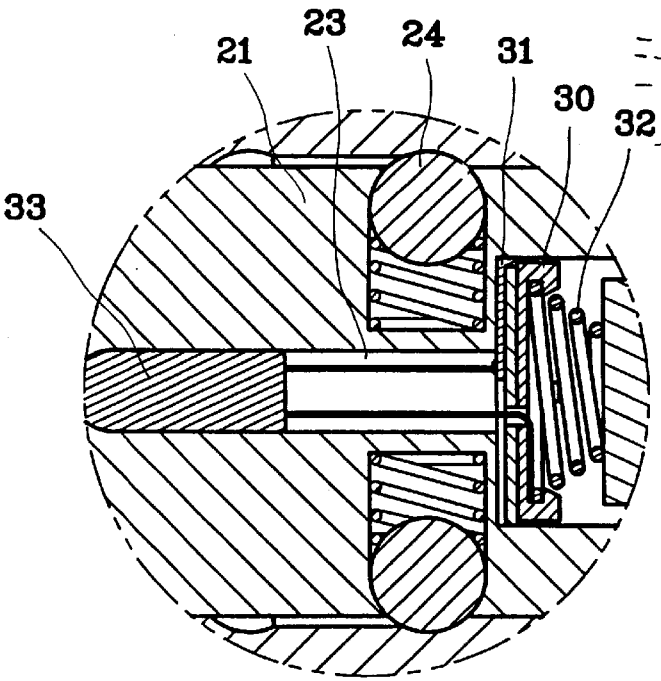
FIG. 3B is an enlarged view of a part of FIG. 3A.

Referring to FIGS. 3, 3A and 3B, when inserting the polygonal coupling head 21 of the socket 20 into the polygonal coupling hole 12 of the wrench 10 to the end to force the steel balls 24 into engagement with the rear locating groove 15, the metal contact spring 32 is forced into contact with one terminal of the battery 34, and the other terminal of the battery 34 is electrically connected to the metal contact plate 31 through the wrench 10 and the socket 20, and therefore the battery 34 is electrically connected to the LED 33, causing the LED 33 to emit light through the polygonal coupling hole 201 (see FIGS. 3A and 3B). When pulling the socket 20 outwards to force the steel balls 24 into engagement with the front locating groove 14, the metal spring 32 is disconnected from the battery 34 to open the circuit, and therefore the battery 34 is disconnected from the LED 33 and the LED 33 is off (see FIG. 3B).

Because the holder plate 30, the metal contact plate 31, the metal spring 32 and the LED 33 are fixedly mounted together and press-fitted into the receiving open chamber 22 of the socket 20 and the battery 34 is directly inserted into the battery chamber 13 of the wrench 10, the light source unit 300 can be removed from the socket 20 and the wrench 10, enabling the wrench 10 to work with the socket 20 without a light source. Because the light source unit 300 is received inside the socket 20 and the wrench 10 when installed, it is not visible from the outside. Because no switch button means is required for controlling the operation of the light source unit 300, the structure of the invention is simple and inexpensive to manufacture.

It is to be understood that the drawings are designed for purposes of illustration only, and are not intended for use as a definition of the limits and scope of the invention disclosed.

What the invention claimed is:

1. A socket wrench and light source arrangement comprising a metal wrench, said wrench comprising a head defining a polygonal socket hole, a metal socket adapted for turning a workpiece by said wrench, said socket comprising a polygonal coupling hole disposed at one end for receiving the workpiece, a polygonal coupling head disposed at an opposite end for coupling to the polygonal socket hole of said wrench, a plurality of compression springs respectively mounted in respective radial holes spaced around the periphery of the polygonal coupling head of said socket, and a plurality of steel balls respectively supported on said compressing springs and adapted to secure said socket to said wrench after insertion of the polygonal coupling head of said socket into the polygonal socket hole of said wrench, and a light source unit installed in said socket and said wrench and controlled to emit light through the polygonal coupling hole of said socket after connection of said socket to said wrench, wherein:

said wrench comprises a front locating groove and a rear locating groove spaced around the periphery of said polygonal socket hole and adapted to receive the steel balls of said socket alternatively after insertion of the polygonal coupling head of said socket into the polygonal socket hole of said wrench, and a battery chamber axially backwardly extend from said polygonal socket hole in the head of said wrench;

said socket comprises a receiving open chamber defined in said polygonal coupling head, and an axial through hole connected between said receiving open chamber and said polygonal coupling hole;

said light source unit comprises a battery inserted into the battery chamber of said wrench, an electrically insulative holder plate fitted into the receiving open chamber of said socket, said holder plate having a front side and a back side, a lamp fixedly mounted on the front side of said holder plate, a metal contact plate fixedly mounted on the front side of said holder plate and connected to one terminal of said lamp and one terminal of said battery through said socket and said wrench upon insertion of the polygonal coupling head of said socket into the polygonal socket hole of said wrench, and a metal spring fixedly mounted on the back side of said holder plate and adapted to contact an opposite terminal of said battery to turn on said lamp after insertion of the polygonal coupling head of said socket into the polygonal socket hole of said wrench to force said steel balls into engagement with the rear locating groove of said wrench, said metal spring being disconnected from said battery to turn off said lamp when said steel balls of said socket are moved with said socket from said rear locating groove of said wrench and forced into engagement with said front locating groove of said wrench.

* * * * *